US005515873A

United States Patent [19]

Dawson et al.

[11] Patent Number: 5,515,873

[45] Date of Patent: May 14, 1996

[54] CIGARETTE MAKING MACHINE

[75] Inventors: John Dawson; Derek H. Dyett, both of High Wycombe; James R. Stembridge, Coventry, all of England

[73] Assignee: Molins PLC, Milton Keynes, England

[21] Appl. No.: 275,350

[22] Filed: Jul. 15, 1994

[30] Foreign Application Priority Data

Jul. 15, 1993 [GB] United Kingdom ..... 9314651

[51] Int. Cl.[6] ..... A24C 5/39

[52] U.S. Cl. ..... 131/109.1; 131/108

[58] Field of Search ..... 131/108–110

[56] References Cited

U.S. PATENT DOCUMENTS

| | | | |
|---|---|---|---|
| 1,636,081 | 7/1927 | Sprenger | 209/135 |
| 2,230,195 | 1/1941 | Warren | 131/109.2 |
| 2,841,154 | 7/1958 | Dearsley | 131/109.1 |
| 3,920,542 | 11/1975 | Laird et al. | 209/134 |
| 5,009,238 | 4/1991 | Heitmann | 131/108 |

FOREIGN PATENT DOCUMENTS

| | | | |
|---|---|---|---|
| 481382 | 8/1929 | Germany | 131/110 |
| 2080667 | 2/1982 | United Kingdom . | |

*Primary Examiner*—Jennifer Bahr
*Attorney, Agent, or Firm*—Antonelli, Terry, Stout & Kraus

[57] ABSTRACT

A hopper for a cigarette making machine has a carded roller (14;52;54;60) arranged to feed a carpet of tobacco, a generally horizontally extending conveyor band (32) for receiving the tobacco from the carded roller, and means for removing the tobacco from the carded roller, for delivery onto the conveyor band, comprising an air pressure source (26;66) and one or more air passages (22;24;56;58;64;68) extending from the air pressure source for directing one or more jets of air into the tobacco to project the tobacco in a generally horizontal direction as a shower onto and along the conveyor band.

6 Claims, 1 Drawing Sheet

CIGARETTE MAKING MACHINE

In the hopper of a cigarette making machine it is common to meter tobacco by means of a carded feed roller from which the tobacco is vigorously removed by means of a picker roller and is then showered pneumatically up a chimney towards a suction band on which the tobacco collects to form a cigarette filler stream. Examples of such machines are the Molins Mark 8, Mark 9 and Mark 10 cigarette making machines.

This invention is concerned particularly with the area of the picker roller, particularly but not exclusively in the context of a machine like the Mark 10 machine in which the carded roller receives tobacco from a column of tobacco formed by tobacco delivered initially by apparatus which is not relevant to this invention. Examples of prior proposals in this connection are described in our British patent specification GB 2102272.

According to one aspect of the present invention, a hopper for a cigarette making machine includes a carded roller arranged to feed a carpet of tobacco, a generally horizontally extending conveyor band for receiving the tobacco from the carded roller, and means for removing the tobacco from the carded roller, for delivery onto the conveyor band, comprising an air pressure source and one or more air passages extending from the air pressure source for directing one or more jets of air into the tobacco to project the tobacco in a generally horizontal direction as a shower onto and along the conveyor band. The tobacco is preferably removed from the carded roller by or with the aid of a picker roller.

The conveyor band preferably moves at a relatively high velocity (for example, about 160 cm per/second) and delivers the tobacco into the lower end of the chimney up which it is showered pneumatically towards the suction band.

This invention is able to handle the tobacco more gently than at least some prior arrangements. For example, in comparison with the designs described in our above-mentioned patent, in which the tobacco is projected substantially downwards by the picker roller towards the conveyor band, the horizontal or generally horizontal projection of the tobacco by means largely of the air jet in the present invention results in less damage to the tobacco particles and also spreads the tobacco more effectively along the conveyor band so as to even out variations in the tobacco flow rate. Moreover, because of the action of the air jet, it is possible to use a lower-speed picker roller. For example, where a typical picker roller previously had a speed of 1100 rpm, with the present invention the speed might be of the order of 360 rpm. This is particularly useful in connection with tobacco which, because of its relative fragility or shortness, needs to be handled with minimal breakage in the hopper.

Examples of hoppers according to this invention are shown in the accompanying diagrammatic drawings, FIGS. 1 to 4, each of which is a cross-section in a vertical plane.

Figure 1:
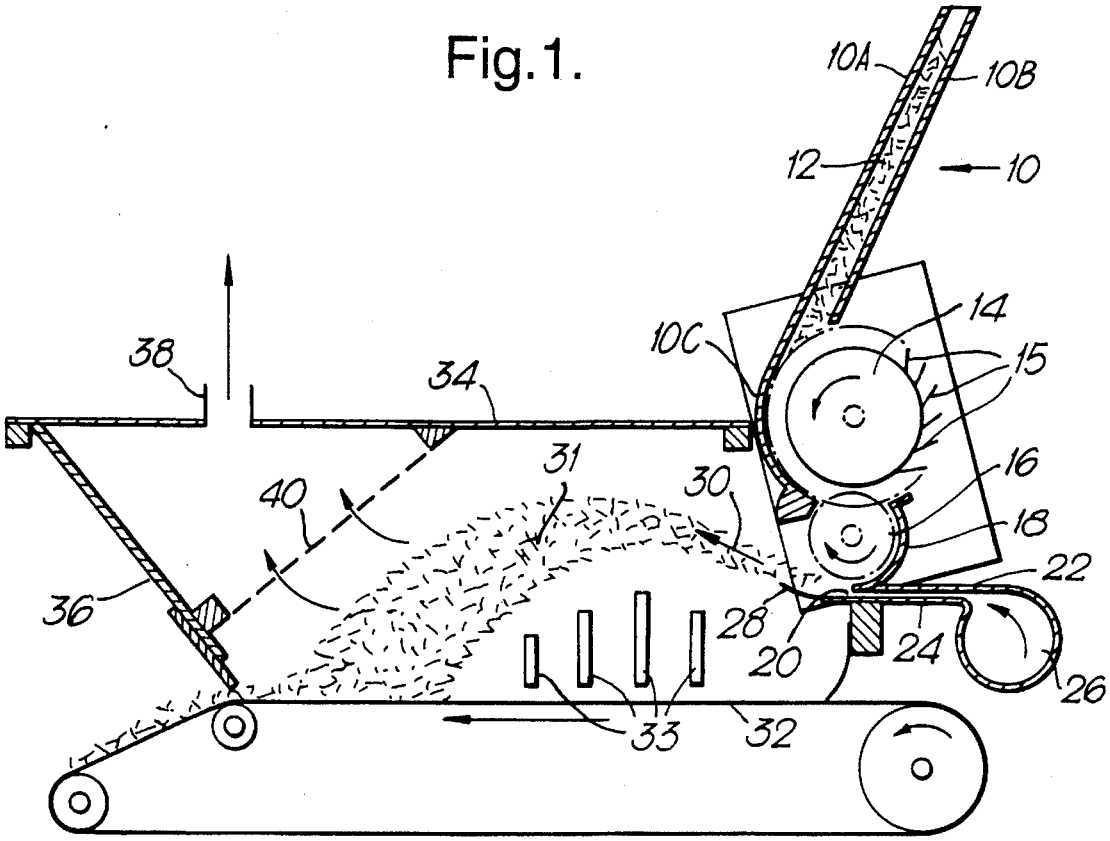

FIG. 1 shows the lower end of a channel 10 formed by substantially parallel walls 10A and 10B in which a column of tobacco 12 is formed as a result of tobacco being fed continuously into the upper end of the channel by a part of the hopper which is not shown.

On leaving the channel 10, the tobacco is conveyed at substantially the same speed along a curved extension 10C of the wall 10A by a carded roller 14 including rows of pins 15 extending around its entire circumference and along its length. At the bottom of the roller 14 the tobacco is removed by a picker roller 16 which rotates in the opposite direction to the roller 14 so as to continue the conveyance of the tobacco in the same direction as it leaves the roller 14. The tobacco is loosened by the picker roller and conveyed along a concave plate 18. At the lower end of this plate there is a nozzle 20 which is formed by closely spaced horizontal plates 22 and 24 between which air flows from a source of air pressure 26.

The gap between the plates 22 and 24 may, for example, be 0.2 mm. The air pressure in the source 26 may be a few inches, e.g. about 5–10 inches (12.7–25.4 cms) of water gauge.

The air jet emanating from the nozzle 20 projects the tobacco particles along a plate 28 which is curved up slightly towards its left-hand end so that the tobacco particles leave the plate with a generally horizontal but slightly upward trajectory as shown by the arrow 30. The tobacco particles thus projected by the air jet (forming a spreading shower 31) land on a conveyor band 32 which delivers the tobacco into the lower end of an upwardly extending chimney (not shown) leading to a suction band in the conventional manner.

Walls 34 and 36 are provided to enclose the area of the projected tobacco, and there is provision for drawing off air from the thus-formed chamber through a pipe 38. A filter screen 40 ensures that tobacco particles do not pass upwards through the pipe 38.

To counter any tendency for an anticlockwise air vortex to be established between the tobacco shower and the conveyor band 32, which could capture small particles of tobacco, fixed transversely-extending baffles 33 may be mounted in the space below the tobacco shower. Alternatively, an additional jet of air from the source 26 may be directed close to and substantially parallel to and in the same direction as the band. Alternatively, the space below the tobacco shower may be blanked off by a curved plate, effectively an extension of the plate 28, extending approximately along the lower surface of the tobacco shower 31, in which case the conveyor band can be shortened by moving the right-hand pulley to the left.

Figure 2:
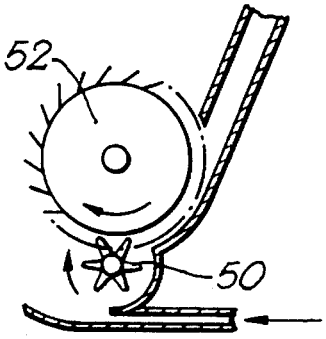
Figure 3:
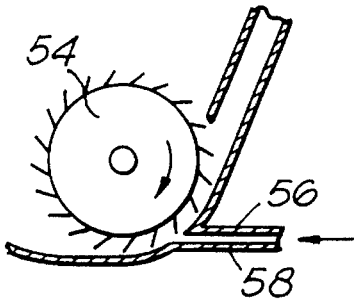
Figure 4:
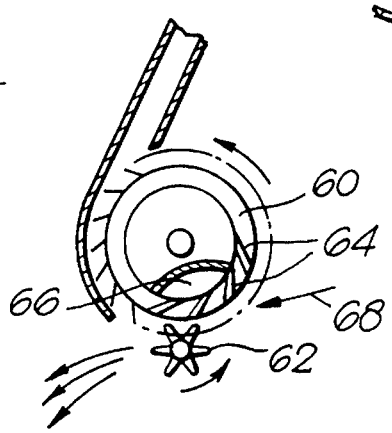

Possible modifications of the construction shown in FIG. 1 are shown in FIGS. 2 to 4.

FIG. 2 shows a construction in which a picker roller 50 rotates in the same direction as a clockwise rotating carded roller 52 from which it therefore removes tobacco with a more vigorous action. This may be possible with tobacco needing slightly less gentle treatment and possibly requiring to be opened up by the action of the picker roller. On the other hand, FIG. 3 shows a possible modification which omits any picker roller and in which the tobacco is "picked" directly from a carded roller 54 by an air jet delivered, as before, by a nozzle defined by upper and lower plates 56 and 58 positioned so as to project the jet through the tobacco as it reaches the bottom of the roller 54. This arrangement may be of use in the case of especially fragile or short tobacco.

FIG. 4 shows an anticlockwise-rotating carded roller 60, as in FIG. 1, with an anticlockwise-rotating picker roller 62. The roller 60 is in the form of a cylinder including rows of passages 64 extending around the entire circumference and length of the roller 60. These passages communicate with a pressure chamber 66 in the roller 60 and are inclined with respect to radii of the roller so that tobacco particles removed from the pins of the roller 60 by the picker roller 62 are blown generally to the left by air jets emanating from the passages 64. In addition, or as an alternative, one or more air jets may be directed in the direction of the arrow 68 to propel the tobacco towards the left as it leaves the roller 60.

As already mentioned, each of the drawings is a cross section in a vertical plane. Typically, the hopper and all the parts shown in the drawings would have a width of between 600 and 1000 mm in order to feed the tobacco into a chimney of similar width.

The tobacco feed arrangement shown in any of these examples may be used to feed tobacco on to a conveyor band which also receives a different kind of tobacco from a separate metering arrangement. For example, tobacco fed to the cigarette making machine may be separated into relatively long and relatively short tobacco particles, for example as described in our British patent specification GB 2215578. The shorter particles of tobacco may be metered by an arrangement such as that shown in any of the Figures of this specification while longer particles are metered and fed onto the conveyor band in a different manner.

We claim:

1. A hopper for a cigarette making machine comprising a carded roller arranged to feed a carpet of tobacco; a generally horizontally extending conveyor band for receiving tobacco from the carded roller; and means for removing tobacco from the carded roller for delivery onto the conveyor band, comprising a concave wall, a picker roller arranged to remove tobacco from the carded roller and to convey the tobacco along said concave wall, an air pressure source, and one or more air passages extending from the air pressure source to the lower end of said concave wall for directing one or more jets of air into the tobacco passing said concave wall to project the tobacco in a generally horizontal direction as a shower onto and along the conveyor band.

2. A hopper according to claim 1, in which the carded roller and picker roller rotate in opposite directions.

3. A hopper for a cigarette making machine comprising a carded roller arranged to feed a carpet of tobacco, a generally horizontally extending conveyor band for receiving the tobacco from the carded roller, and means for removing the tobacco from the carded roller, for delivery onto the conveyor band, comprising a picker roller cooperating with the carded roller to remove tobacco from the carded roller and an air pressure source and one or more air passages extending from said air pressure source for directing one or more jets of air horizontally into the tobacco to assist the removal of the tobacco from the carded roller and to project the tobacco in a generally horizontal direction as a shower onto and along the conveyor band.

4. A hopper according to claim 3 in which at least some of the air jets are produced by passages in the carded roller communicating with an air pressure chamber (66) in the carded roller.

5. A hopper according to any one of claims 1, 2, 4 and 3, including one or more fixed baffles mounted between the tobacco shower and the conveyor band to counter any tendency for a vortex to form in the space between the shower and the band.

6. A method for feeding tobacco in a cigarette making machine, comprising feeding tobacco by means of a carded roller onto a generally horizontally extending conveyor band, the tobacco being removed from the carded roller, for delivery onto the conveyor band, by an air pressure source and one or more air passages extending from the air pressure source for directing one or more jets of air into the tobacco to project the tobacco in a generally horizontal direction as a shower onto and along the conveyor band.

* * * * *